US009368927B2

(12) United States Patent
Kawamura et al.

(10) Patent No.: US 9,368,927 B2
(45) Date of Patent: Jun. 14, 2016

(54) CONNECTOR

(71) Applicant: JAPAN AVIATION ELECTRONICS INDUSTRY, LIMITED, Shibuya-ku, Tokyo (JP)

(72) Inventors: Chikara Kawamura, Tokyo (JP); Yukitaka Tanaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/576,073

(22) Filed: Dec. 18, 2014

(65) Prior Publication Data

US 2015/0244117 A1 Aug. 27, 2015

(30) Foreign Application Priority Data

Feb. 21, 2014 (JP) ..... 2014-032267

(51) Int. Cl.
*H01R 24/60* (2011.01)
*H01R 13/6471* (2011.01)
*H01R 12/72* (2011.01)

(52) U.S. Cl.
CPC ..... *H01R 24/60* (2013.01); *H01R 13/6471* (2013.01); *H01R 12/724* (2013.01)

(58) Field of Classification Search
USPC ..... 439/660, 626, 79, 885, 676; 174/359
See application file for complete search history.

(56) References Cited

U.S. PATENT DOCUMENTS 7,210,945 B1 * 5/2007 Ying ..... H01R 13/502 439/79
7,413,467 B1 * 8/2008 Lai ..... H01R 13/641 439/489
7,682,163 B2 * 3/2010 Hou ..... H01R 12/712 439/79

(Continued)

FOREIGN PATENT DOCUMENTS

JP 2009009729 A 1/2009
JP 3159900 U 5/2010
JP 2012054215 A 3/2012

*Primary Examiner* — Alexander Gilman
(74) *Attorney, Agent, or Firm* — Holtz, Holtz & Volek PC

(57) ABSTRACT

A connector is mateable with a mating connector along a mating direction. The mating connector includes a plurality of mating contacts. The connector comprising a plurality of contacts which are held by a housing. Each of the contacts has a contact portion, a terminal portion and an intersecting portion. The terminal portion is positioned at a position different from a position of the contact portion in a pitch direction perpendicular to the mating direction. The intersecting portion is positioned between the contact portion and the terminal portion. The intersecting portions intersect both the mating direction and the pitch direction in a plane which is defined by the mating direction and the pitch direction. The contacts include at least a plurality of first contacts and a plurality of second contacts. The contact portions of the second contacts are positioned apart from the contact portions of the first contacts in a predetermined direction perpendicular to both the mating direction and the pitch direction. The first contacts include signal contacts which constitute at least one differential pair. The signal contacts of the differential pair have shapes same as each other.

9 Claims, 11 Drawing Sheets

(56) References Cited

U.S. PATENT DOCUMENTS 7,845,982 B1 * 12/2010 Wang ..... H01R 13/506
439/607.25
7,942,704 B2 * 5/2011 Ko ..... H01R 13/6477
439/607.1
8,568,172 B1 * 10/2013 Lan ..... H01R 12/57
439/607.4
8,662,936 B2 * 3/2014 Chung ..... H01R 13/6471
439/607.35
8,777,672 B2 * 7/2014 Chung ..... H01R 13/6461
439/607.35
9,142,920 B2 * 9/2015 Oyake ..... H01R 13/6467
2007/0066115 A1 * 3/2007 Saito ..... H01R 13/65802
439/260
2009/0186528 A1 * 7/2009 Chen ..... H01R 13/6582
439/660
2013/0323944 A1 * 12/2013 Hamada ..... H01R 12/724
439/65
2013/0344739 A1 * 12/2013 Shih ..... H01R 13/658
439/607.28

* cited by examiner

CONNECTOR

CROSS REFERENCE TO RELATED APPLICATIONS

An applicant claims priority under 35 U.S.C. §119 of Japanese Patent Application No. JP2014-032267 filed Feb. 21, 2014.

BACKGROUND OF THE INVENTION

This invention relates to a connector which comprises signal contacts constituting at least one differential pair for high-speed signal transmission.

With reference to FIGS. 21 and 22, a connector 101 of JPA 2012-54215 (Patent Document 1) comprises a plurality of contacts, a housing 102 and a shell 103. The contacts are held by the housing 102. The housing 102 is covered by the shell 103. The contacts are divided into two groups. Contact portions 201 of the contacts of each group are arranged in one row in a pitch direction. In other words, the contact portions 201 of the contacts are arranged in two rows. On the other hand, terminal portions 202 of the contacts of the two groups are arranged in one row in the pitch direction. Specifically, the terminal portions 202 of the contacts of one of the two groups are arranged alternately with the terminal portions 202 of the contacts of a remaining one of the two groups in the pitch direction. The contacts include signal contacts which constitute at least one differential pair for high-speed signal transmission. In addition, Patent Document 1 dose not disclose which is a signal contact among the contacts.

The connector 101 of Patent Document 1 does not include contacts which have shapes same as each other. Thus, in the connector 101 of Patent document 1, if any two of the contacts constitute one differential pair, it is difficult to perform impedance matching therebetween. Accordingly, the connector 101 of the Patent Document 1 has a problem that skew is easily introduced.

SUMMARY OF THE INVENTION

It is an object of the present invention to provide a connector which can suppress skew between contacts which constitute one differential pair.

One aspect of the present invention provides a connector which is mateable with a mating connector along a mating direction. The mating connector includes a plurality of mating contacts. The connector is mounted and fixed on an object when used. The connector comprises a housing and a plurality of contacts. The contacts are held by the housing. Each of the contacts has a contact portion, a terminal portion and an intersecting portion. The contact portions are to be in contact with the mating contacts, respectively. The terminal portions are connected to the object when the connector is used. The terminal portion is positioned at a position different from a position of the contact portion in a pitch direction perpendicular to the mating direction. The intersecting portion is positioned between the contact portion and the terminal portion. The intersecting portions intersect both the mating direction and the pitch direction in a plane which is defined by the mating direction and the pitch direction. The contacts include at least a plurality of first contacts and a plurality of second contacts. The contact portions of the first contacts are arranged in one row in the pitch direction. The contact portions of the second contacts are arranged in one row in the pitch direction. The contact portions of the second contacts are positioned apart from the contact portions of the first contacts in a predetermined direction perpendicular to both the mating direction and the pitch direction. The terminal portions of the first contacts and the terminal portions of the second contacts are arranged in one row in the pitch direction. The first contacts include signal contacts which constitute at least one differential pair. The signal contacts of the differential pair have shapes same as each other.

As described above, each of the contacts has the intersecting portion intersecting both the mating direction and the pitch direction in the plane which is defined by the mating direction and the pitch direction. Thus, a position of the contact portion can be deviated from a position of the terminal portion in the pitch direction. In addition, an arrangement of the contacts by using the intersecting portions enables the signal contacts constituting the differential pair to have shapes same as each other. Accordingly, skew can be suppressed between the signal contacts which constitute the differential pair.

An appreciation of the objectives of the present invention and a more complete understanding of its structure may be had by studying the following description of the preferred embodiment and by referring to the accompanying drawings.

Figure 1:
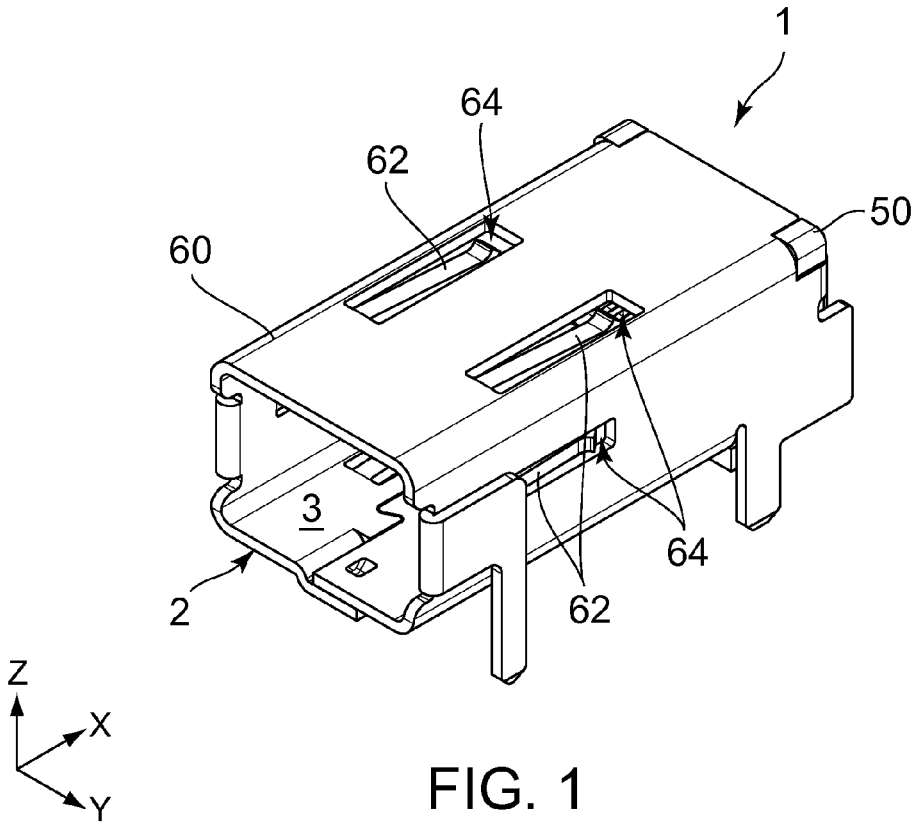
FIG. 1 is a front, perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

With reference to FIGS. 1 to 4, a connector 1 according to an embodiment of the present invention is mounted and fixed to on an object such as a circuit board (not shown) when used. The connector 1 comprises a plurality of first contacts (contacts) 10, a plurality of second contacts (contacts), a housing 50 and a shell 60. Each of the first contacts 10 is made of conductor. Each of the second contacts 20 is made of conductor. The housing 50 is made of insulator. The shell 60 is made of metal. The connector 1 according to the present embodiment is a receptacle having a receiving portion 3 which is opened at a mating end 2. A mating connector is a plug (not shown) which includes a plurality of mating contacts. The connector 1 according to the present embodiment receives a part of the plug (not shown) in the receiving portion 3, so that the connector 1 of receptacle according to the present embodiment is mated with the plug (not shown) along an X-direction (mating direction).

Figure 3:
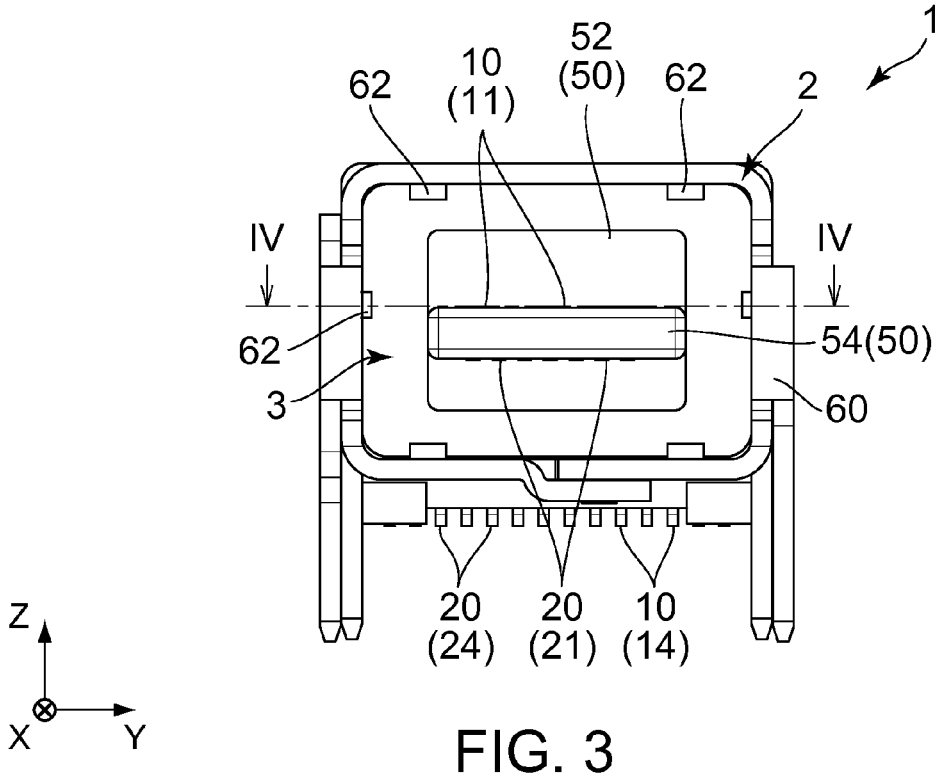
FIG. 3 is a front view showing the connector of FIG. 1.
Figure 4:
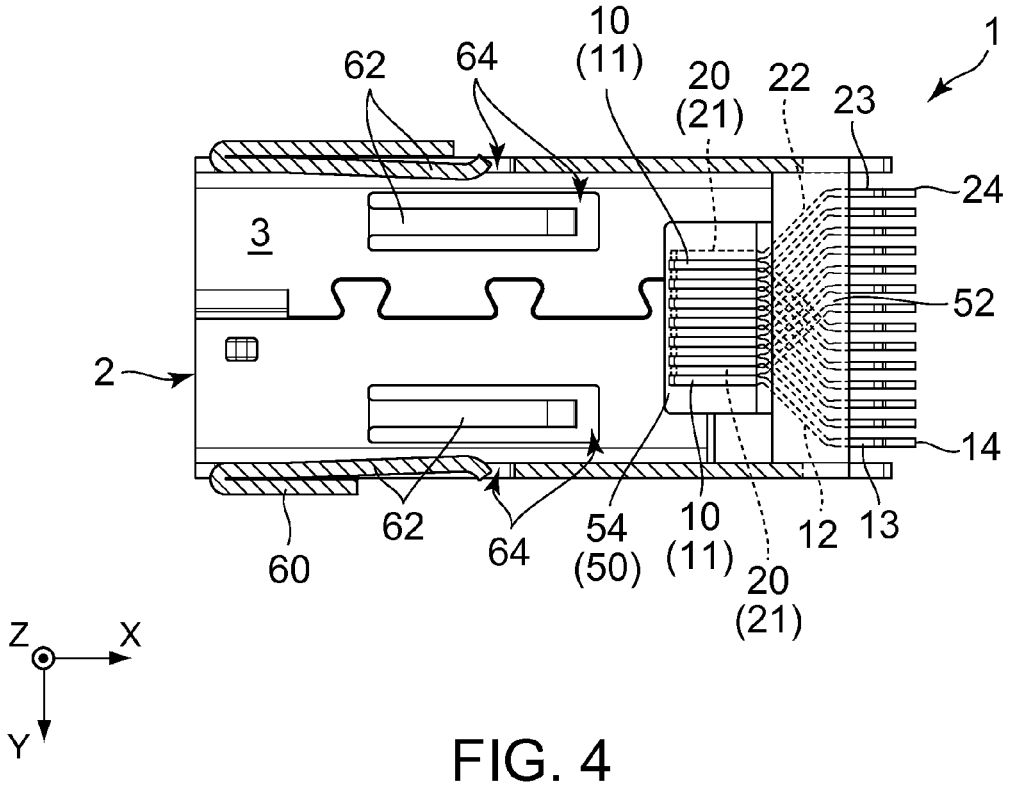
FIG. 4 is a cross-sectional view showing the connector of FIG. 3, taken along line IV-IV, wherein a part of a housing and a part of contacts are transparently illustrated.

As shown in FIGS. 3 and 4, the housing 50 has a block-like holding portion 52 and a plate-like portion 54. As shown in FIG. 4, the holding portion 52 holds a part of each of the first contacts 10 and a part of each of the second contacts 20. The holding of the first contacts 10 and the second contacts 20 is described later in detail. As understood from FIGS. 3 and 4, the plate-like portion 54 extends in parallel with a plane (XY-plane) which is defined by the X-direction and a Y-direction (pitch direction), and projects from the holding portion 52 toward the mating end 2 (i.e. toward a negative X-side).

As shown in FIGS. 1 to 4, the shell 60 partly covers the housing 50. As understood from FIG. 4, the shell 60 of the present embodiment has a shape which is long in the X-direction. Specifically, in the X-direction, the shell 60 has a length which is two or more times longer than a length of the housing 50. Accordingly, stress applied to the first contacts 10 and the second contacts 20 can be reduced even if the mating connector (not shown) is unintentionally bent in a state where the connector 1 is mated with the mating connector (not shown).

Figure 2:
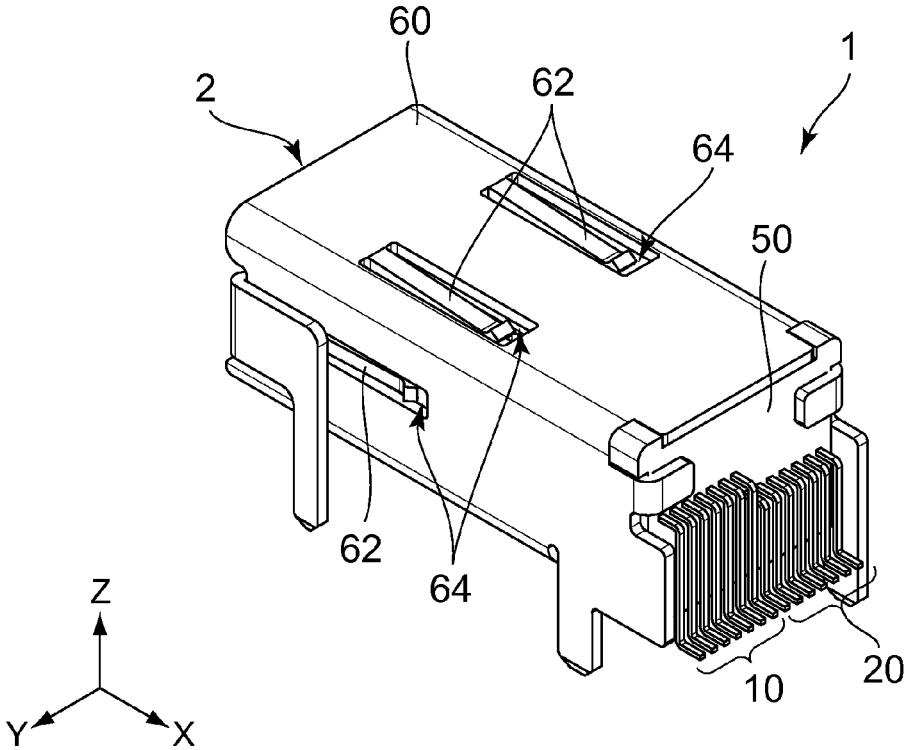
FIG. 2 is a rear, perspective view showing the connector of FIG. 1.

As shown in FIGS. 1, 2 and 4, the shell 60 of the present embodiment is provided with a plurality of spring portions 62 which are to be connected with a mating shell (not shown) of the mating connector (not shown). In addition, the shell 60 is formed with a plurality of openings 64 so as to form the spring portions 62. As best illustrated in FIG. 4, each of the openings 64 is positioned closer to the mating end 2 than the housing 50, the first contacts 10 and the second contacts 20. In other words, each of the openings 64 is positioned between the housing 50 and the mating end 2 while positions of the openings 64 are different from a position of the housing 50 in the X-direction. Especially, the plate-like portion 54 is perfectly surrounded by the shell 60 in a YZ-plane perpendicular to the X-direction. Accordingly, the connector 1 of the present embodiment has a high resistance to EMI (Electro-Magnetic Interference).

In the present embodiment, the first contacts 10 are used for signal transmission while the second contacts 20 are used for signal reception. Specifically, in the present embodiment, the first contacts 10 and the second contacts 20 belong to signal systems different from each other. However, the present invention is not limited thereto. For example, both of the first contacts 10 and the second contacts 20 are used for signal transmission and signal reception, depending on their uses.

As shown in FIGS. 4 to 7, each of the first contacts 10 has a contact portion 11, an intersecting portion 12, a coupling portion 13, a terminal portion 14 and a tip portion 15. The contact portions 11 are portions which contact the mating contacts (not shown) of the mating connector (not shown), respectively. The contact portion 11 is perpendicular to both the Y-direction and Z-direction (predetermined direction), and extends along the X-direction. Each of the intersecting portions 12 extend obliquely from the contact portion 11. Specifically, the intersecting portions 12 of the present embodiment intersect both the X-direction and the Y-direction in the XY-plane. In detail, each of the intersecting portions 12 extends toward a positive X-direction and a positive Y-direction from the contact portion 11. In other words, the intersecting portions 12 of the present embodiment are oblique to both the X-direction and the Y-direction in the XY-plane. The coupling portion 13 has an L-like shape and couples the intersecting portion 12 with the terminal portion 14. As understood from the above explanation, the intersecting portion 12 is positioned between the contact portion 11 and the terminal portion 14. When the connector 1 is used, the terminal portions 14 are connected to the object (not shown) such as a circuit board. As best illustrated in FIG. 4, due to a shape and an arrangement of the intersecting portion 12, the terminal portion 14 is positioned at a position different from a position of the contact portion 11 in the Y-direction. The tip portion 15 is provided at an end of the contact portion 11 and extends toward a negative Z-direction so as to intersect with the X-direction.

Figure 5:
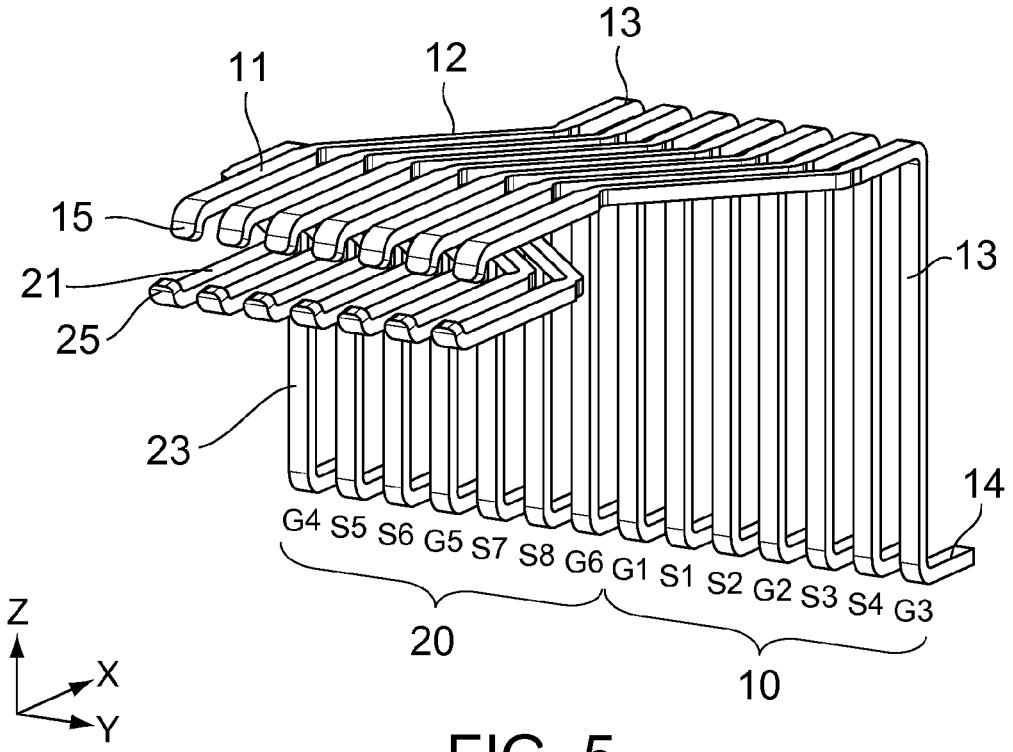
FIG. 5 is a perspective view showing the contacts which are included in the connector of FIG. 4.
Figure 6:
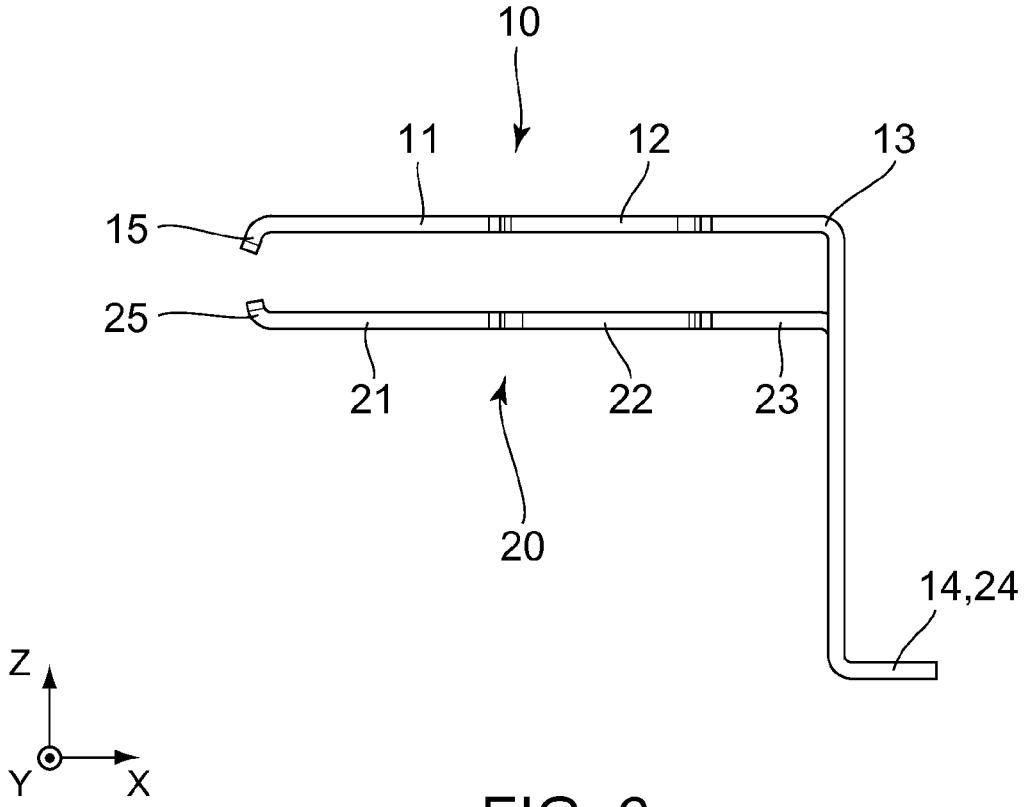
FIG. 6 is a side view showing the contacts of FIG. 5.
Figure 7:
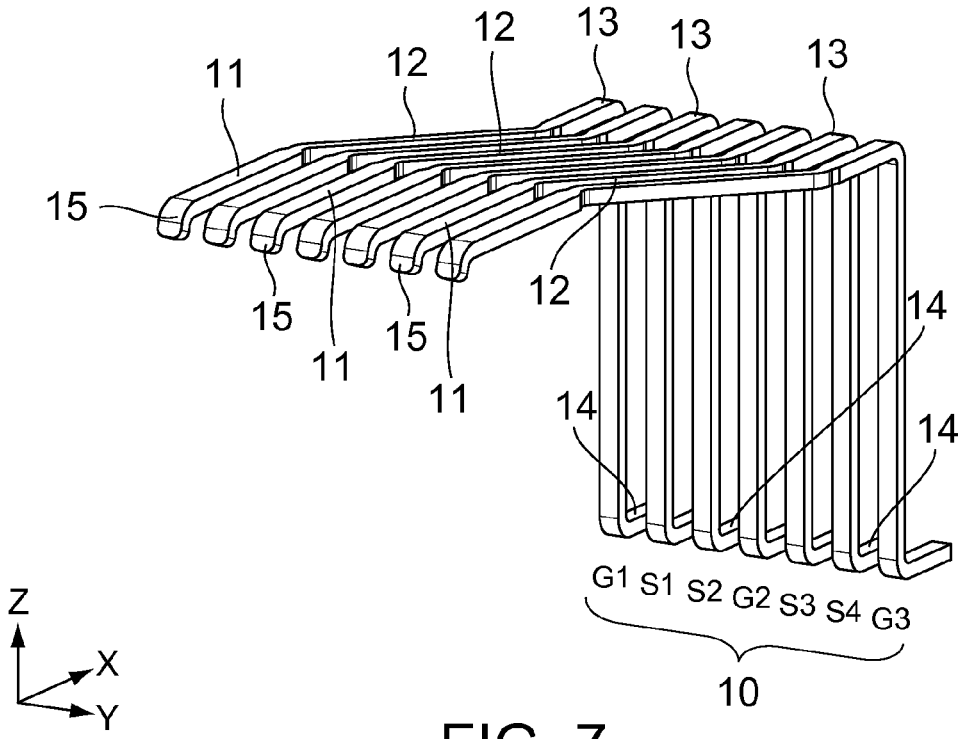
FIG. 7 is a perspective view showing first contacts among the contacts of FIG. 5.

As shown in FIGS. 5 to 7, the first contacts 10 have shapes same as each other. As understood from FIGS. 5 and 7, the first contacts 10 include four signal contacts S1, S2, S3 and S4 and three ground contacts G1, G2 and G3. The signal contacts S1 and S2 constitute one differential pair, and the signal contacts S3 and S4 constitute another differential pair. As understood from the above explanation, the signal contacts S1 and S2 which constitute the differential pair have shapes same as each other, and the signal contacts S3 and S4 which constitute the differential pair have shapes same as each other.

As shown in FIGS. 4 to 6 and 8, each of the second contacts 20 has a contact portion 21, an intersecting portion 22, a coupling portion 23, a terminal portion 24 and a tip portion 25, similar to the first contacts 10. The contact portions 21 are portions which contact the mating contacts (not shown) of the mating connector (not shown), respectively. The contact portion 21 is perpendicular to both the Y-direction and the Z-direction (predetermined direction), and extends along the X-direction. Each of the intersecting portions 22 extend obliquely from the contact portion 21. Specifically, the intersecting portions 22 of the present embodiment intersect both the X-direction and the Y-direction in the XY-plane. In detail, each of the intersecting portions 22 extends from the contact portion 21 toward the positive X-direction and a negative Y-direction. In other words, the intersecting portions 22 of the present embodiment are oblique to both the X-direction and the Y-direction in the XY-plane. The coupling portion 23 has an L-like shape and couples the intersecting portion 22 with the terminal portion 24. As understood from the above explanation, the intersecting portion 22 is positioned between the contact portion 21 and the terminal portion 24. When the connector 1 is used, the terminal portions 24 are connected to the object (not shown) such as a circuit board. As best illustrated in FIG. 4, due to a shape and an arrangement of the intersecting portion 22, the terminal portion 24 is positioned at a position different from a position of the contact portion 21 in the Y-direction. The tip portion 25 is provided at an end of the contact portion 21 and extends toward a positive Z-direction so as to intersect with the X-direction.

Figure 8:
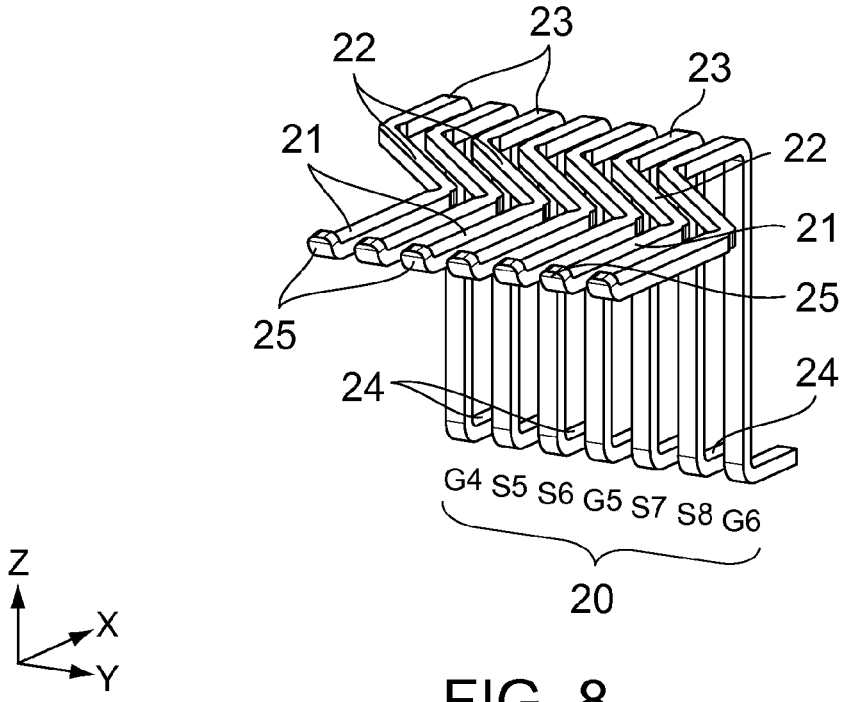
FIG. 8 is a perspective view showing second contacts among the contacts of FIG. 5.

As shown in FIGS. 5, 6 and 8, the second contacts 20 have shapes same as each other. As understood from FIGS. 5 and 8, the second contacts 20 include four signal contacts S5, S6, S7 and S8 and three ground contacts G4, G5 and G6. The signal contacts S5 and S6 constitute one differential pair, and the signal contacts S7 and S8 constitute another differential pair. As understood from the above explanation, the signal contacts S5 and S6 which constitute the differential pair have shapes same as each other, and the signal contacts S7 and S8 which constitute the differential pair have shapes same as each other.

As understood from the above-described shapes of the coupling portions 13, 23, the connector 1 of the present embodiment is a so-called right angle connector (see FIG. 2). However, the present invention is not limited thereto. The connector 1 may be a straight connector.

The terminal portions 14, 24 of the present embodiment are SMT (surface mount technology) terminals fixed on a surface of the object (not shown) such as a circuit board by soldering or the like. Each of the terminal portions 14, 24 of the present embodiment extends from a negative Z-side end of the coupling portion 13, 23 so as to have an angle of 90 degrees with respect to the coupling portion 13, 23. However, the present invention is not limited thereto. Each of the terminal portions 14, 24 may be designed to be mounted to the object (not shown) such as a circuit board using through-hole technology (THT), wherein each of the terminal portions 14, 24 is inserted into a through-hole (not shown) formed on the object (not shown) and is fixed by soldering or the like.

The first contacts 10 and the second contacts 20 of the present embodiment are installed into and held by the housing 50 upon the molding of the housing 50 via insert-molding process. Specifically, as shown in FIG. 4, each of the intersecting portions 12, 22 is entirely embedded in the housing 50. In detail, almost all of the intersecting portions 12, 22 are embedded in the housing 50. However, the present invention is not limited thereto. The first contacts 10 and the second contacts 20 may be held by the housing 50 by another method such as press-fitting or the like.

As shown in FIGS. 3 and 4, the contact portions 11 are arranged in one row in the Y-direction on one of principal surfaces (positive Z-side principal surface) of the plate-like portion 54 of the housing 50, and the contact portions 21 are arranged in one row in the Y-direction on a remaining one of the principal surfaces (negative Z-side principal surface) of the plate-like portion 54 of the housing 50. Specifically, the contact portions 11 are arranged in parallel to each other at regular intervals in the Y-direction. Similarly, the contact portions 21 are arranged in parallel to each other at regular intervals in the Y-direction. Meanwhile, the tip portions 15, 25 (see FIG. 5) are embedded in the plate-like portion 54. Therefore, when the connector 1 is mated with the mating connector (not shown), the tip portions 15 of the first contacts 10 and the tip portions 25 of the second contacts 20 do not receive a force directly from the mating connector so that the first contacts 10 and the second contacts 20 can be prevented from being buckled.

The contact portions 21 are positioned apart from the contact portions 11 in the Z-direction. Specifically, the tip portions 15 of the first contacts 10 and the tip portions 25 of the second contacts 20 are arranged in two rows. Especially, as shown in FIG. 4, the contact portions 11 are arranged so as to be deviated, by half of their pitch, from the contact portions 21. In other words, the contact portions 11 are positioned alternately with the contact portions 21 in the Y-direction.

On the other hand, as understood from FIGS. 4 to 6, the terminal portions 14 and the terminal portions 24 are arranged in one row in the Y-direction. Specifically, the terminal portions 14 and the terminal portions 24 are arranged in parallel to each other at regular intervals in the Y-direction.

As described above, the connector 1 according to the present embodiment includes four differential pairs. The signal contacts S1 and S2 which constitute the differential pair are interposed between the ground contacts G1 and G2. Similarly, the signal contacts S3 and S4 which constitute the differential pair are interposed between the ground contacts G2 and G3. In other words, the ground contact G2 is positioned between two differential pairs: one differential pair of the signal contacts S1 and S2 and another differential pair of the signal contacts S3 and S4. Accordingly, a risk of a mutual effect of the two differential pairs to each other is reduced. In addition, the signal contacts S5 and S6 which constitute the differential pair are interposed between the ground contacts G4 and G5. Similarly, the signal contacts S7 and S8 which constitute the differential pair are interposed between the ground contacts G5 and G6. In other words, the ground contact G5 is positioned between two differential pairs: one differential pair of the signal contacts S5 and S6 and another differential pair of the signal contacts S7 and S8. Accordingly, a risk of a mutual effect of the two differential pairs to each other is reduced.

Furthermore, the contact portions 11, 21 are arranged at regular intervals, and the terminal portions 14, 24 are arranged at regular intervals. As understood from the above description, in any one of the differential pairs, a shortest distance from one of the signal contacts to one of the ground contacts closest thereto is same as a shortest distance from a remaining one of the signal contacts to one of the ground contacts closest thereto. For example, a shortest distance from the signal contact S1 to the ground contact G1 is same as a shortest distance from the signal contact S2 to the ground contact G2. Thus, since the signal contacts of each differential pair have shapes same as each other and receive effects from ground potential etc. which are same as each other, skew is hardly introduced between the signal contacts of each differential pair.

In addition, as described above, the contact portions 11 and the contact portions 21 are positioned alternately in the Y-direction. Accordingly, even if the plate-like portion 54 is thin, relatively large distances can be secured between the contact portions 11 and the contact portions 21 in the YZ-plane, so that a cross talk can be reduced.

As described above, each of the intersecting portions 12 extends from the contact portion 11 toward the positive X-direction and the positive Y-direction, and each of the intersecting portions 22 extends from the contact portion 21 toward the positive X-direction and the negative Y-direction (see FIG. 4). In other words, the intersecting portions 12 of the first contacts 10 and the intersecting portions 22 of the second contacts 20 extend toward orientations same as each other in the X-direction and extend toward orientations different from each other in the Y-direction. Accordingly, even in a case where the tip portions 15 of the first contacts 10 and the tip portions 25 of the second contacts 20 are arranged in two rows while the terminal portions 14 of the first contacts 10 and the terminal portions 24 of the second contacts 20 are arranged in one row, the first contacts 10 can have shapes same as each other while the second contacts 20 can have shapes same as each other.

While the present invention has been described with specific embodiments, the present invention is not limited to the aforementioned embodiments. Various modifications and applications are possible with the present invention. For example, although the above-described connector 1 is the right angle connector, the connector 1 may be the straight connector. Although the first contacts 10 and the second contacts 20 have SMT terminals as described above, the first contacts 10 and the second contacts 20 may have terminals which are designed to be mounted to the circuit board (not shown) using THT. In the above-described connector 1, the tip portions 15 of the first contacts 10 and the tip portions 25 of the second contacts 20 are arranged in two rows while the terminal portions 14 of the first contacts 10 and the terminal portions 24 of the second contacts 20 are arranged in one row. The tip portions 15 of the first contacts 10 and the tip portions 25 of the second contacts 20 may be arranged in three or more rows. The terminal portions 14 of the first contacts 10 and the terminal portions 24 of the second contacts 20 may be arranged in two or more rows.

Figure 9:
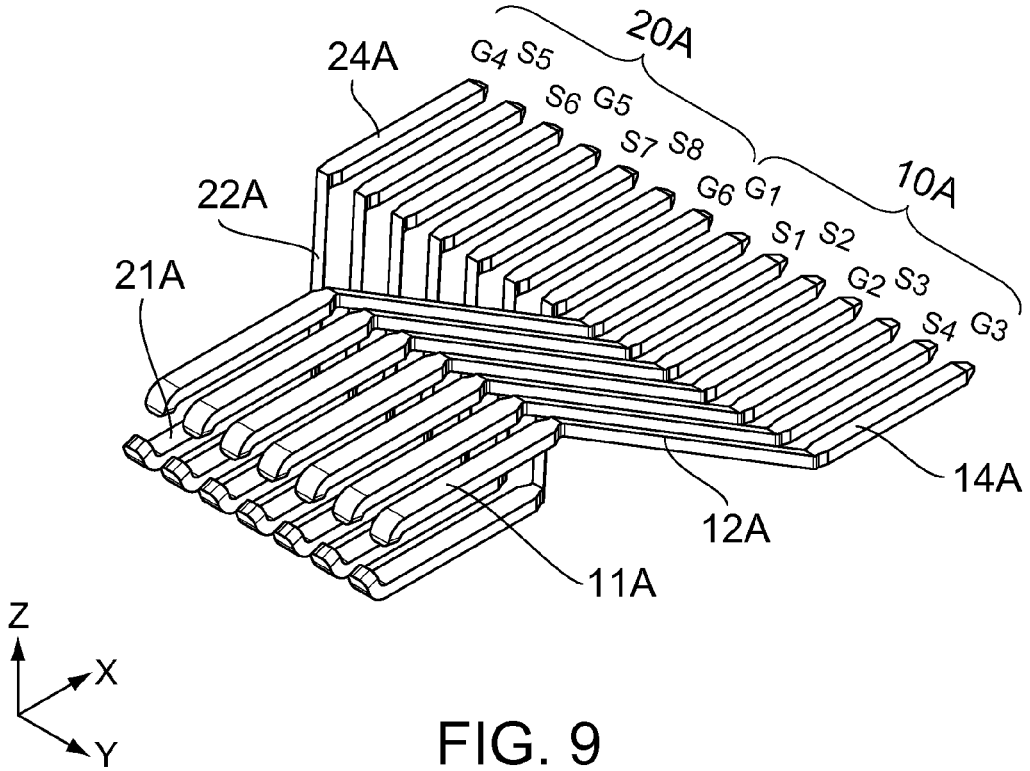
FIG. 9 is a perspective view showing contacts which are included in a modification of the connector.
Figure 10:
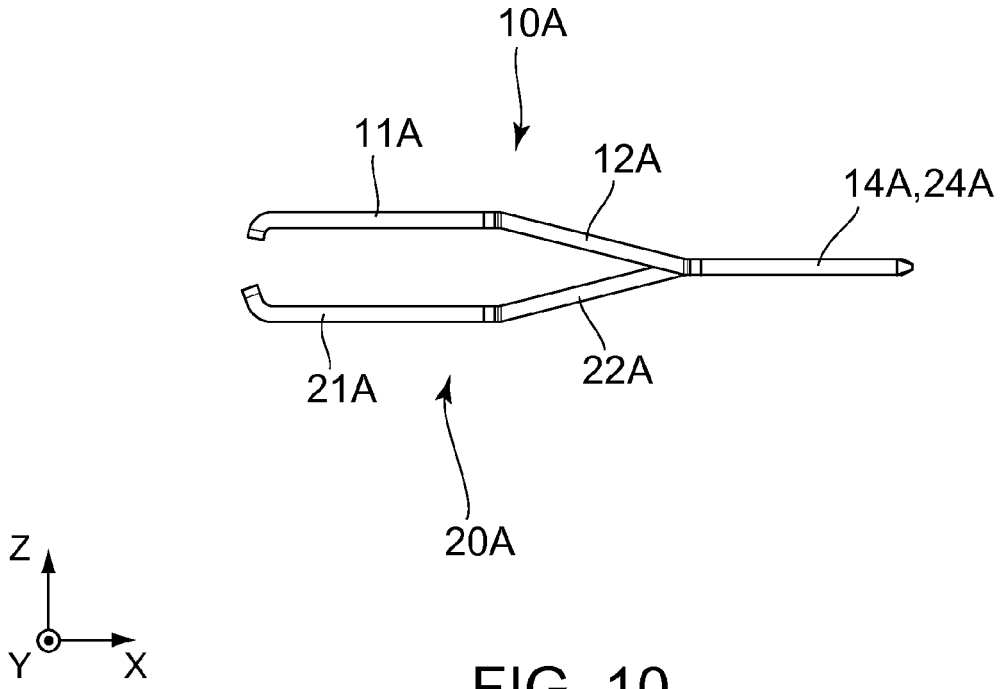
FIG. 10 is a side view showing the contacts of FIG. 9.
Figure 11:
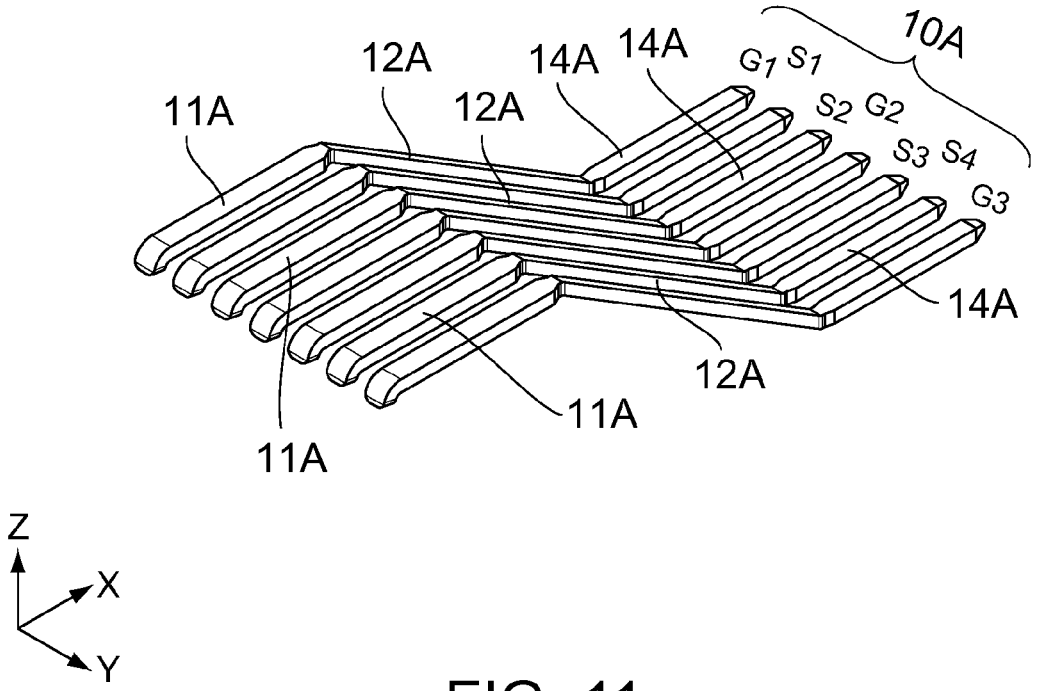
FIG. 11 is a perspective view showing first contacts among the contacts of FIG. 9.
Figure 12:
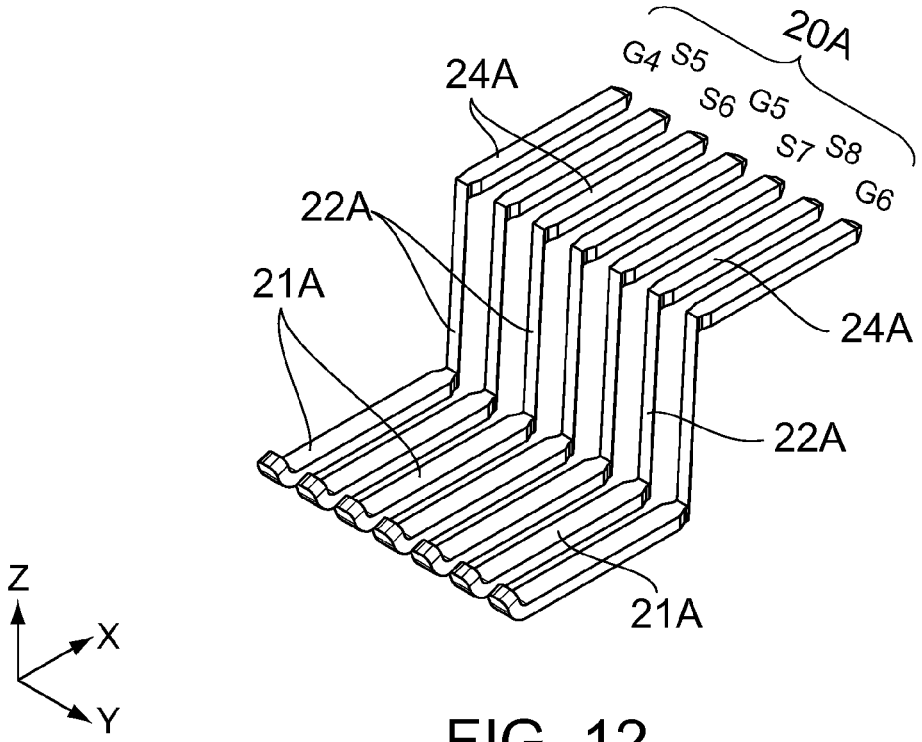
FIG. 12 is a perspective view showing second contacts among the contacts of FIG. 9.
Figure 13:
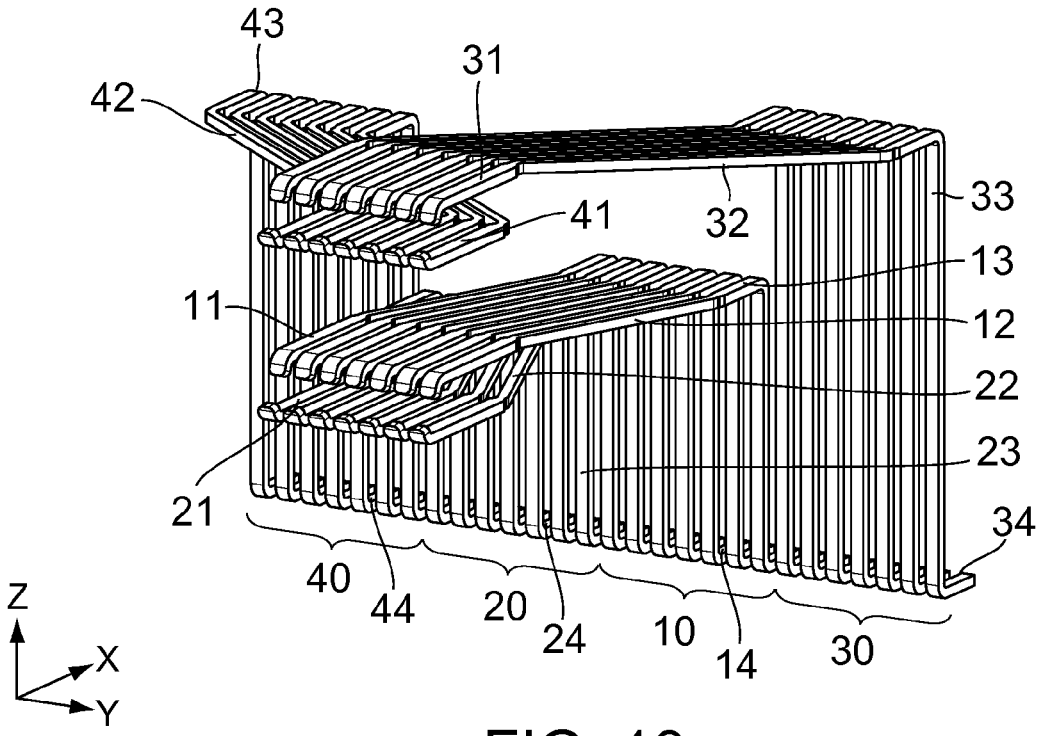
FIG. 13 is a perspective view showing contacts which are included in another modification of the connector.
Figure 14:
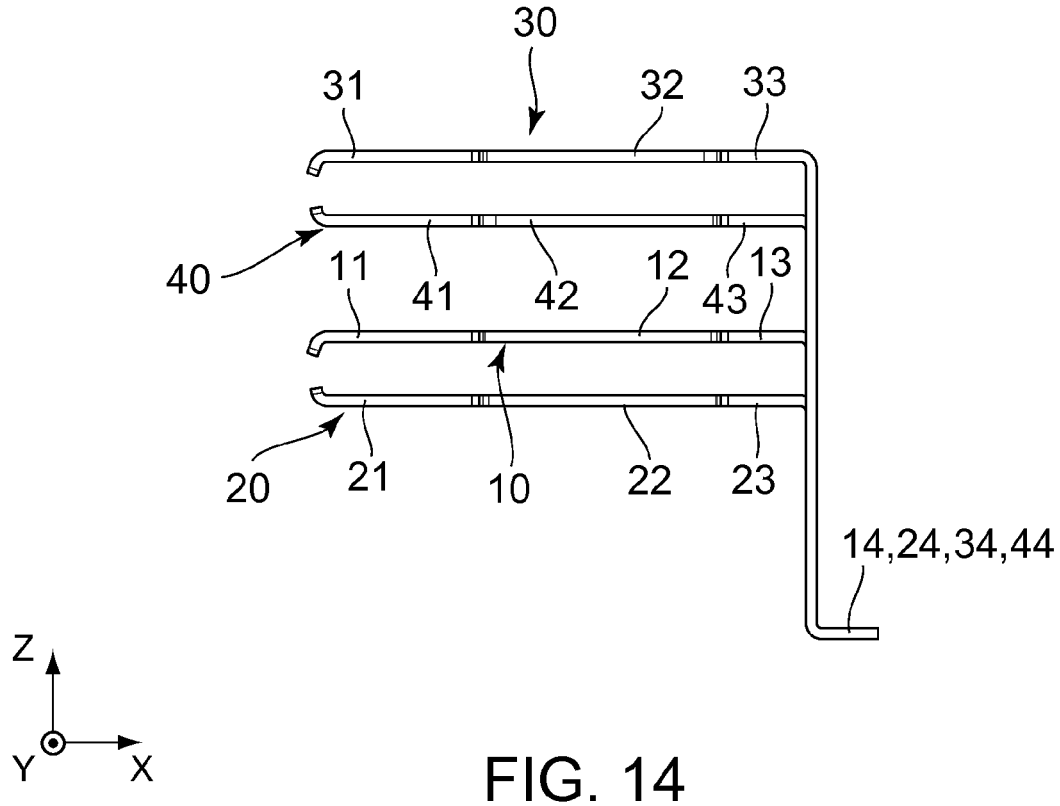
FIG. 14 is a side view showing the contacts of FIG. 13.
Figure 15:
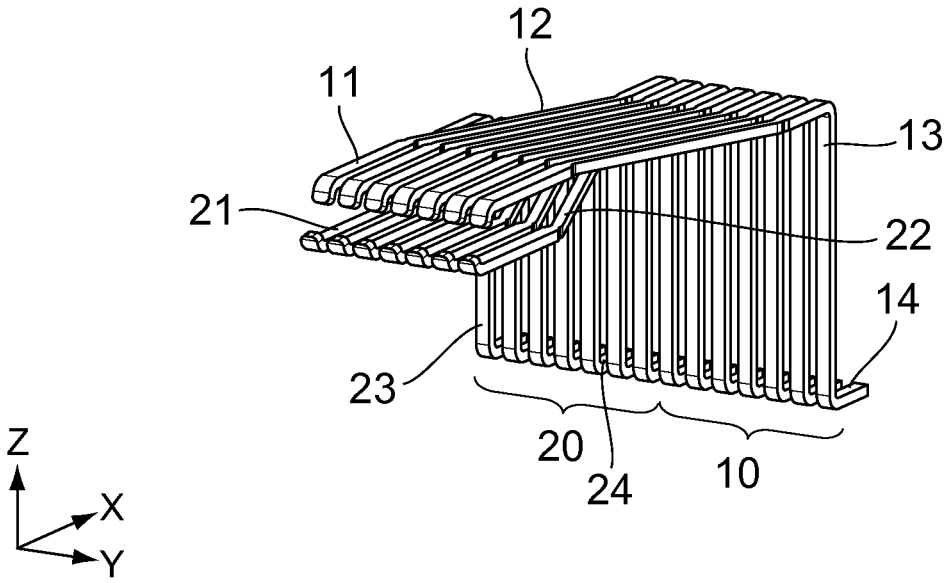
FIG. 15 is a perspective view showing a collection of contacts among the contacts of FIG. 13.
Figure 16:
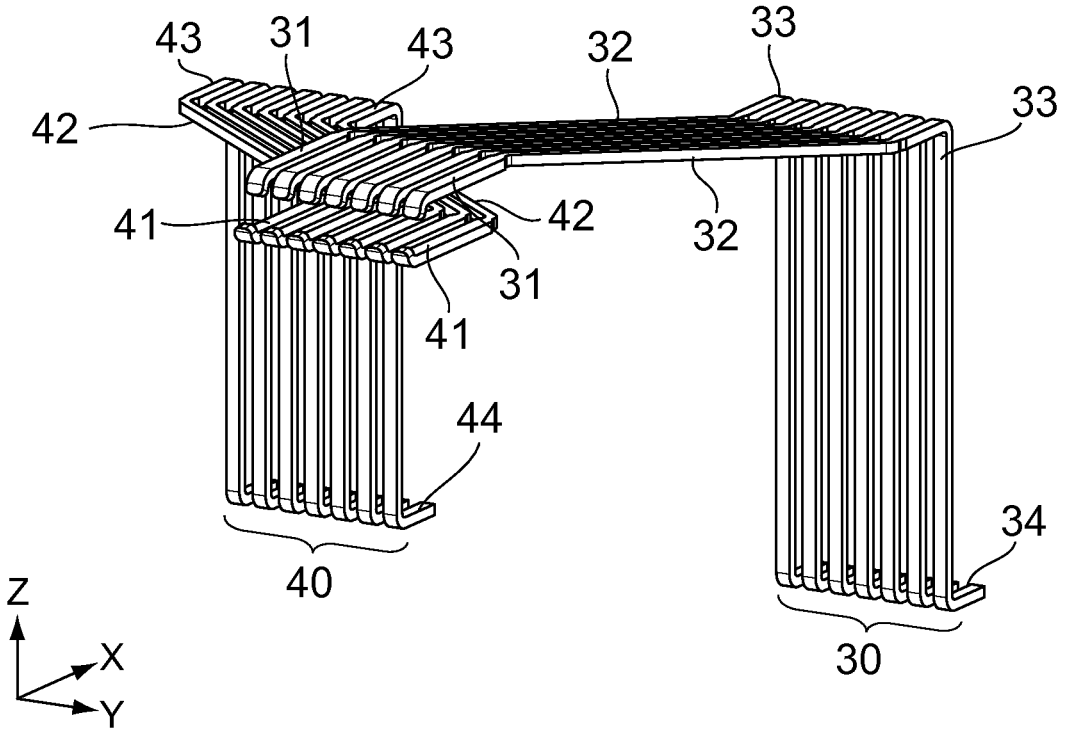
FIG. 16 is a perspective view showing another collection of contacts among the contacts of FIG. 13.
Figure 17:
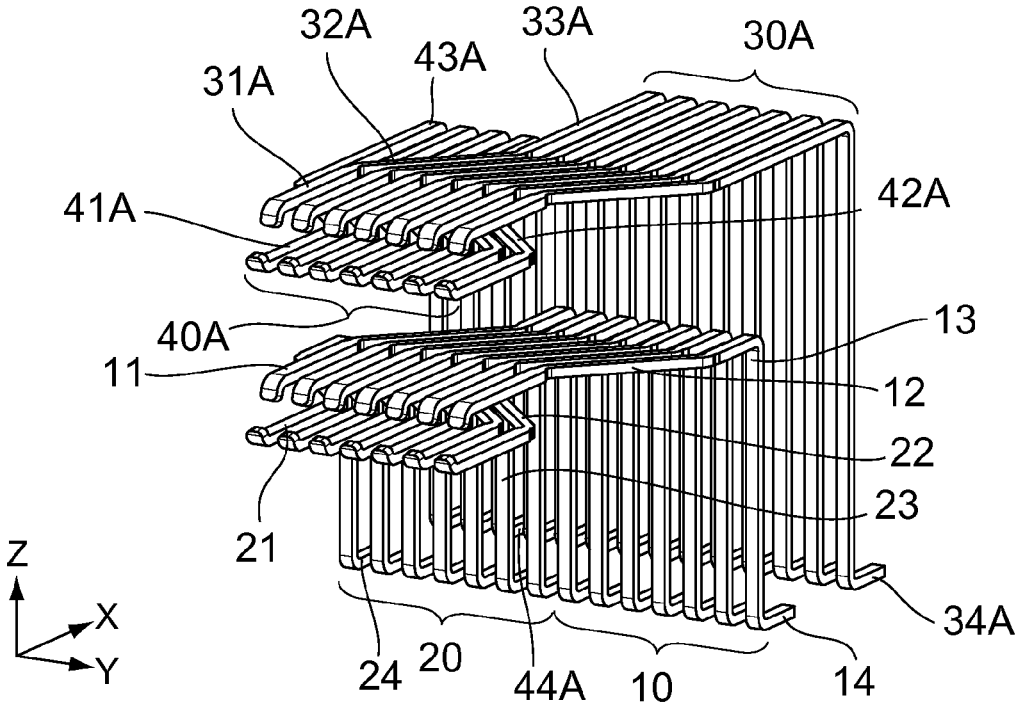
FIG. 17 is a perspective view showing contacts which are included in yet another modification of the connector.
Figure 18:
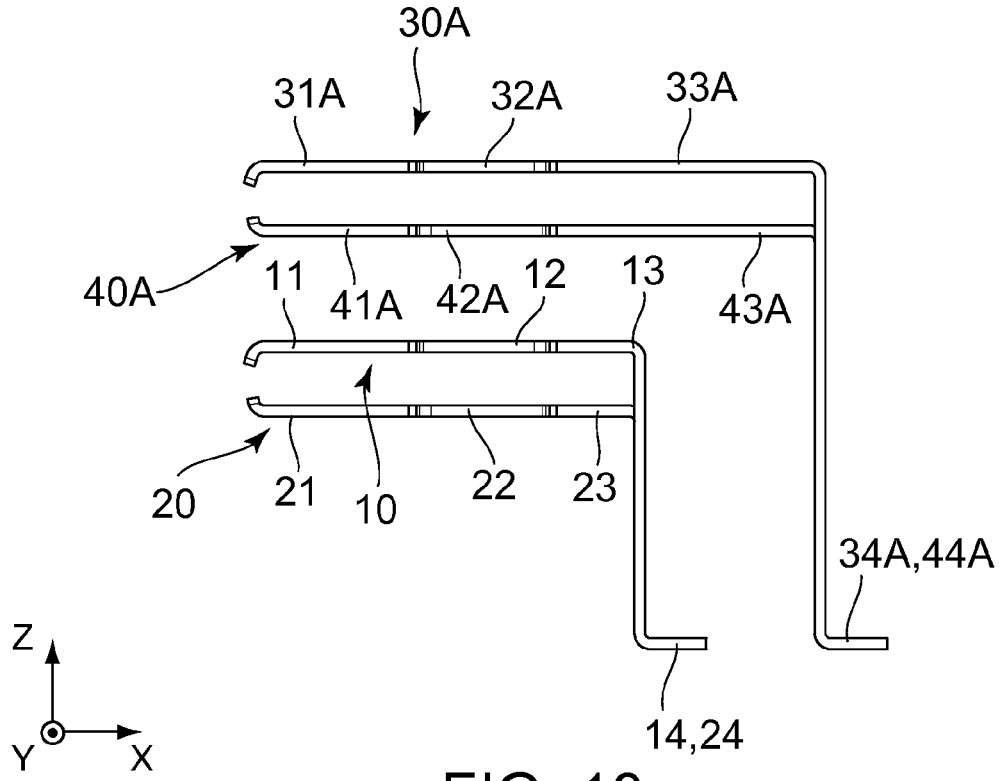
FIG. 18 is a side view showing the contacts of FIG. 17.
Figure 19:
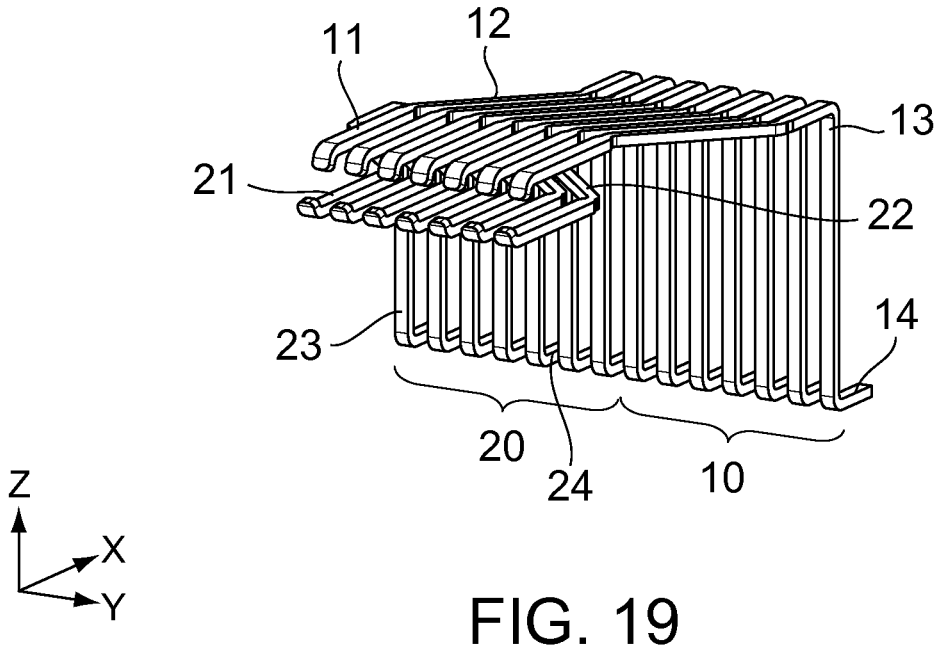
FIG. 19 is a perspective view showing a collection of contacts among the contacts of FIG. 17.
Figure 20:
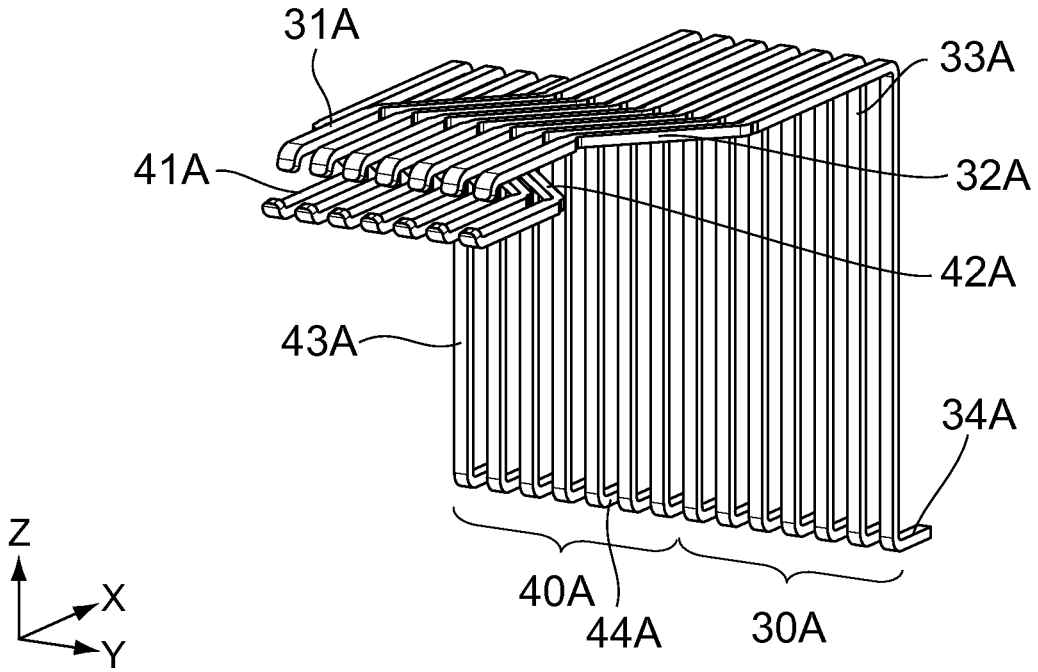
FIG. 20 is a perspective view showing another collection of contacts among the contacts of FIG. 17.
Figure 21:
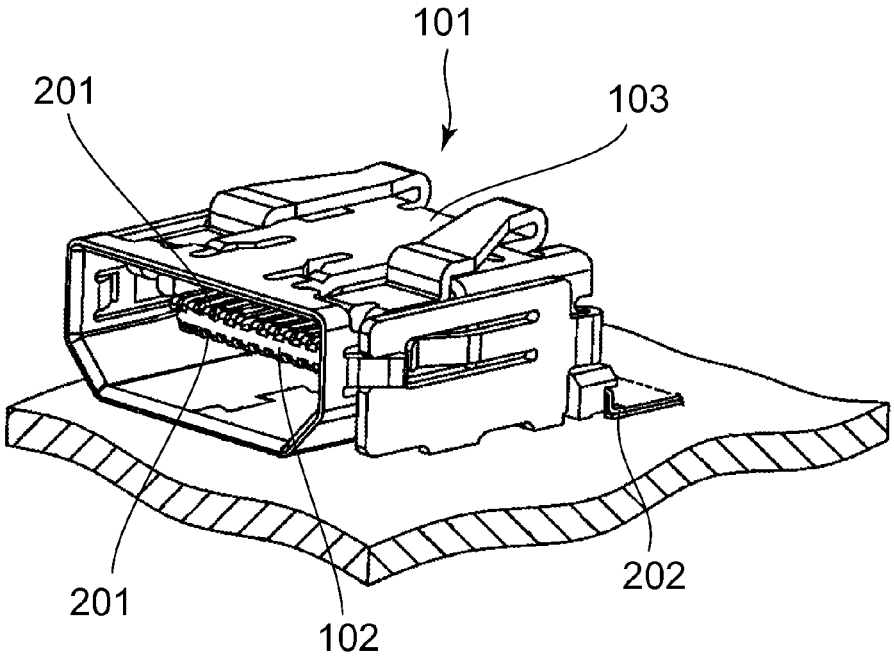
FIG. 21 is a front, perspective view showing a connector of Patent Document 1.
Figure 22:
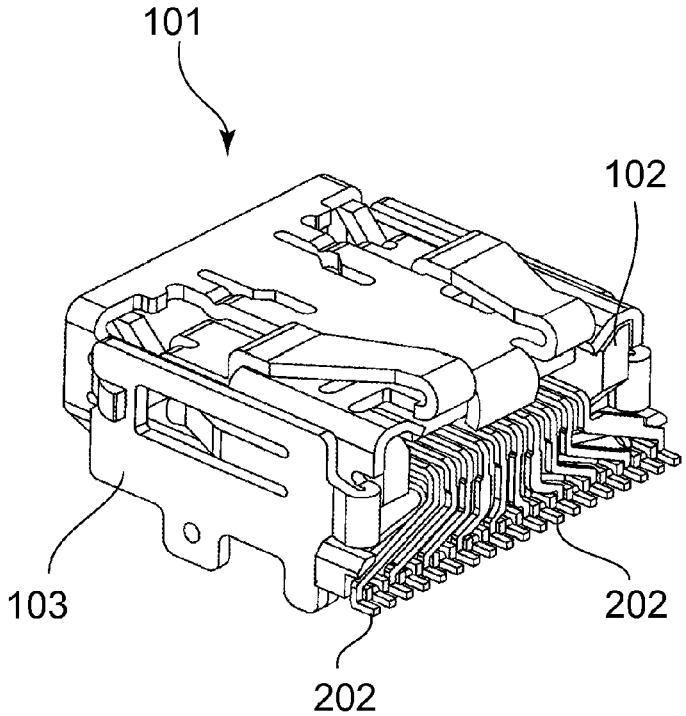
FIG. 22 is a rear, perspective view showing the connector of Patent Document 1.

With reference to FIGS. 9 to 12, each of first contacts 10A according to a first modification has a contact portion 11A, an intersecting portion 12A and a terminal portion 14A. Similarly, each of second contacts 20A according to the first modification has a contact portion 21A, an intersecting portion 22A and a terminal portion 24A. The first contacts 10A have shapes same as each other. The second contacts 20A have shapes same as each other. The contact portions 11A are arranged in one row at regular intervals in the Y-direction. The contact portions 21A are arranged in one row at regular intervals in the Y-direction. The contact portions 21A are positioned apart from the contact portions 11A in the Z-direction. Thus, the contact portions 11A, 21A are arranged in two rows. The intersecting portions 12A, 22A intersect the X-direction, the Y-direction and the Z-direction. Specifically, each of the intersecting portions 12A extends from the contact portion 11A toward the positive X-direction, the positive Y-direction and the negative Z-direction. On the other hand, each of the intersecting portions 22A extends from the contact portion 21A toward the positive X-direction, the negative Y-direction and the positive Z-direction. Each of the terminal portions 14A extends linearly from the intersecting portion 12A toward the positive X-direction. Each of the terminal portions 24A extends linearly from the intersecting portion 22A toward the positive X-direction. As shown in FIG. 9, the terminal portions 14A and the terminal portions 24A are arranged in one row at regular intervals in the Y-direction. As shown in FIG. 10, each of the terminal portion 14A and the terminal portion 24A is positioned at a position equidistant from the contact portion 11A and the contact portion 21A in the Z-direction. As understood from the above explanation, each of the first contacts 10A has a first length from the contact portion 11A to the terminal portion 14A, each of the second contacts 20A has a second length from the contact portion 21A to the terminal portion 24A, and the first length is equal to the second length. In other words, a signal path length of each of the first contacts 10A is same as a signal path length of each of the second contacts 20A.

A connector comprising the first contacts 10A and the second contacts 20A according to the first modification is not the right angle connector, but the straight connector.

As understood from shapes of the terminal portions 14A, 24A, the terminal portions 14A, 24A are designed to be mounted to the circuit board (not shown) using THT.

With reference to FIGS. 13 to 16, contacts according to a second modification include third contacts 30 and fourth contacts 40 in addition to the above-described first contacts 10 and the above-described second contacts 20. The third contacts 30 include the ground contacts and the signal contacts which are arranged in a manner same as the above-described arrangement of the first contacts 10 and the second contacts 20. Similarly, the fourth contacts 40 include the ground contacts and the signal contacts which are arranged in the same manner as the above-described arrangement of the first contacts 10 and the second contacts 20.

Each of the third contacts 30 has a contact portion 31, an intersecting portion 32, a coupling portion 33 and a terminal portion 34. Similarly, each of the fourth contacts 40 has a contact portion 41, an intersecting portion 42, a coupling portion 43 and a terminal portion 44. The third contacts 30 have shapes same as each other. The fourth contacts 40 have shapes same as each other. The contact portions 41 are positioned apart from the contact portions 31 in the Z-direction. The contact portions 31 are arranged in one row at regular intervals in the Y-direction. The contact portions 41 are arranged in another row at regular intervals in the Y-direction. Thus, the contact portions 31 and the contact portions 41 are arranged in two rows. As understood from tip shapes of the third contacts 30 and the fourth contacts 40, a housing (not shown) according to the second modification is provided with two of the plate-like portions. The contact portions 31 of the third contacts 30 are arranged on a surface of one of the plate-like portions, and the contact portions 41 of the fourth contacts 40 are arranged on a back surface of the one of the plate-like portions which is opposite to the surface in the Z-direction. Similar to the intersecting portions 12 and the intersecting portions 22, the intersecting portions 32 and the intersecting portions 42 extend so as to intersect both the X-direction and the Y-direction in the XY-plane. Specifically, each of the intersecting portions 32 extends from the contact portion 31 toward the positive X-direction and the positive Y-direction, and each of the intersecting portions 42 extends from the contact portion 41 toward the positive X-direction and the negative Y-direction. The intersecting portions 32 extend farther toward the positive Y-direction than the intersecting portions 12, respectively. The intersecting portions 42 extend farther toward the negative Y-direction than the intersecting portions 22, respectively. Each of the coupling portions 33 extends from a positive X-side end of the intersecting portion 32 so as to form an L-shape. Each of the coupling portions 43 extends from a positive X-side end of the intersecting portion 42 so as to form an L-shape. Each of the terminal portions 34 is an SMT terminal which extends from the negative Z-side end of the coupling portion 33 toward the positive X-direction. Each of the terminal portions 44 is an SMT terminal which extends from the negative Z-side end of the coupling portion 43 toward the positive X-direction. Together with the terminal portions 14 and 24, the terminal portions 34 and 44 are arranged in one row at regular intervals in the Y-direction.

With reference to FIGS. 17 to 20, contacts according to a third modification include third contacts 30A and fourth contacts 40A in addition to the above-described first contacts 10 and the above-described second contacts 20. The third contacts 30A include the ground contacts and the signal contacts which are arranged in a manner same as the above-described arrangement of the first contacts 10 and the second contacts 20. Similarly, the fourth contacts 40A include the ground contacts and the signal contacts which are arranged in the same manner as the above-described arrangement of the first contacts 10 and the second contacts 20.

Each of the third contacts 30A has a contact portion 31A, an intersecting portion 32A, a coupling portion 33A and a terminal portion 34A. Similarly, each of the fourth contacts 40A has a contact portion 41A, an intersecting portion 42A, a coupling portion 43A and a terminal portion 44A. The third contacts 30A have shapes same as each other. The fourth contacts 40A have shapes same as each other. The contact portions 41A are positioned apart from the contact portions 31A in the Z-direction. The contact portions 31A are arranged in one row at regular intervals in the Y-direction. The contact portions 41A are arranged in another row at regular intervals in the Y-direction. Thus, the contact portions 31A and the contact portions 41A are arranged in two rows. As understood from tip shapes of the third contacts 30A and the fourth contacts 40A, a housing (not shown) according to the third modification is provided with two of the plate-like portions. The contact portions 31A of the third contacts 30A are arranged on a surface of one of the plate-like portions, and the contact portions 41A of the fourth contacts 40A are arranged on a back surface of the one of the plate like portions which is opposite to the surface in the Z-direction. Similar to the intersecting portions 12 and the intersecting portions 22, the intersecting portions 32A and the intersecting portions 42A extend so as to intersect both the X-direction and the Y-direction in the XY-plane. Specifically, each of the intersecting portions 32A extends from the contact portion 31A toward the positive X-direction and the positive Y-direction, and each of the intersecting portions 42A extends from the contact portion 41A toward the positive X-direction and the negative Y-direction. Each of the coupling portions 33A extends from a positive X-side end of the intersecting portion 32A so as to form an L-shape. Each of the coupling portions 43A extends from a positive X-side end of the intersecting portion 42A so as to form an L-shape. Especially, as understood from FIGS. 17 and 18, each of the contact portions 31A has a size same as the contact portion 11. Each of the contact portions 41A has a size same as the contact portion 21. Each of the intersecting portions 32A has a size same as the intersecting portion 12. Each of the intersecting portions 42A has a size same as the intersecting portion 22. Each of the terminal portions 34A has a size same as the terminal portion 14. Each of the terminal portions 44A has a size same as the terminal portion 24. In contrast, each of the coupling portions 33A is larger than the coupling portion 13, and each of the coupling portions 43A is larger than the coupling portion 23. Each of the terminal portions 34A is an SMT terminal which extends from the negative Z-side end of the coupling portion 33A toward the positive X-direction. Each of the terminal portions 44A is an SMT terminal which extends from the negative Z-side end of the coupling portion 43A toward the positive X-direction. Similar to the terminal portions 14, 24, the terminal portions 34A, 44A are arranged in one row at regular intervals in the Y-direction. The terminal portions 34A, 44A are positioned apart from the terminal portions 14, 24 in the X-direction. In other words, the terminal portions 14 of the first contacts 10, the terminal portions 24 of the second contacts 20, terminal portions 34A of the third contacts 30A and the terminal portions 44A of the fourth contacts 40A are arranged in two rows.

According to the modifications, it is also possible to obtain an effect similar to the above-described embodiment.

The present application is based on Japanese patent application of JP2014-032267 filed before the Japan Patent Office on Feb. 21, 2014, the contents of which are incorporated herein by references.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a mating direction, the mating connector including a plurality of mating contacts, the connector being mounted and fixed on an object when used, the connector comprising:

a housing; and a plurality of contacts which are held by the housing, each of the contacts having a contact portion, a terminal portion and an intersecting portion, the contact portions being configured to contact with the mating contacts, respectively, the terminal portions being connected to the object when the connector is used, the terminal portion being positioned at a position different from a position of the contact portion in a pitch direction perpendicular to the mating direction, the intersecting portion being positioned between the contact portion and the terminal portion, each of the intersecting portions intersecting both the mating direction and the pitch direction in a plane which is defined by the mating direction and the pitch direction, the contacts including at least a plurality of first contacts and a plurality of second contacts, the contact portions of the first contacts being arranged in one row in the pitch direction, the contact portions of the second contacts being arranged in one row in the pitch direction, the contact portions of the second contacts being positioned apart from the contact portions of the first contacts in a predetermined direction perpendicular to both the mating direction and the pitch direction, the terminal portions of the first contacts and the terminal portions of the second contacts being arranged in one row in the pitch direction, the first contacts including signal contacts which constitute at least one differential pair, and the signal contacts of the differential pair having same shapes as each other.

2. The connector as recited in claim 1, wherein each of the intersecting portions of the first contacts and each of the intersecting portions of the second contacts extend toward orientations same as each other in the mating direction and extend toward orientations different from each other in the pitch direction.

3. The connector as recited in claim 1, wherein:

the first contacts have same shapes as each other; and the second contacts have same shapes as each other.

4. The connector as recited in claim 1, wherein:

each of the first contacts has a first length from the contact portion to the terminal portion;

each of the second contacts has a second length from the contact portion to the terminal portion; and the first length is equal to the second length.

5. The connector as recited in claim 1, wherein:

the first contacts further include ground contacts, the ground contacts being arranged so that the signal contacts of the differential pair are interposed between the ground contacts; and a shortest distance from one of the signal contacts to one of the ground contacts closest thereto is equal to a shortest distance from a remaining one of the signal contacts to one of the ground contacts closest thereto.

6. The connector as recited in claim 1, wherein each of the intersecting portions is entirely embedded in the housing.

7. The connector as recited in claim 1, wherein the contact portions of the first contacts are positioned alternately with the contact portions of the second contacts in the pitch direction.

8. The connector as recited in claim 1, wherein the first contacts and the second contacts belong to signal systems different from each other.

9. The connector as recited in claim 1, wherein:

the connector further comprises a shell, the shell at least partly covering the housing; and in the mating direction, the shell has a length which is two or more times longer than a length of the housing.

* * * * *